US007026535B2

(12) United States Patent
Eruera

(10) Patent No.: US 7,026,535 B2
(45) Date of Patent: Apr. 11, 2006

(54) COMPOSITION ASSISTING DEVICE

(76) Inventor: Tauraema Eruera, 7 Browning Street Grey Lynn, Auckland (NZ)

( * ) Notice: Subject to any disclaimer, the term of this patent is extended or adjusted under 35 U.S.C. 154(b) by 2 days.

(21) Appl. No.: 10/471,753

(22) PCT Filed: Mar. 27, 2002

(86) PCT No.: PCT/NZ02/00043

§ 371 (c)(1),
(2), (4) Date: Apr. 13, 2004

(87) PCT Pub. No.: WO02/077853

PCT Pub. Date: Oct. 3, 2002

(65) Prior Publication Data

US 2004/0159213 A1 Aug. 19, 2004

(30) Foreign Application Priority Data

Mar. 27, 2001 (NZ) ..... 510799

(51) Int. Cl.
*G10H 7/00* (2006.01)

(52) U.S. Cl. ..... 84/609

(58) Field of Classification Search ..... 84/609, 84/634

See application file for complete search history.

(56) References Cited

U.S. PATENT DOCUMENTS

| | | | | |
|---|---|---|---|---|
| 4,399,731 A | | 8/1983 | Aoki | 84/1 |
| 4,664,010 A | | 5/1987 | Sestero | 84/1 |
| 5,003,860 A | | 4/1991 | Minamitaka | 84/609 |
| 5,088,380 A | | 2/1992 | Minamitaka | 84/637 |
| 5,099,740 A | | 3/1992 | Minamitaka | 84/651 |
| 5,218,153 A | | 6/1993 | Minamitaka | 84/613 |
| 5,281,754 A | * | 1/1994 | Farrett et al. | 84/609 |
| 5,451,709 A | | 9/1995 | Minamitaka | 84/609 |
| 5,883,326 A | * | 3/1999 | Goodman et al. | 84/649 |
| 5,982,643 A | | 11/1999 | Phlipot | 363/25 |
| 6,051,770 A | | 4/2000 | Milburn et al. | 84/611 |
| 6,103,964 A | | 8/2000 | Kay | 84/611 |
| 6,124,543 A | | 9/2000 | Aoki | 84/609 |

OTHER PUBLICATIONS

Biletskyy, Computer Music Journal, vol. 24, No. 3, (Fall 2000), pp. 34-37, Doctro Webern: A Visual Environment for Computer . . ..

Langston, Computer Music Journal, vol. 15, No. 1, (Spring 2001), pp. 28-39, IMG/1: An Incidental Music Generator.

Thompson, KeyKit—Musical Fun with Windows, Tasks and Objects: Reference Manual for the KeyKit Language—Version 6.5a,Jun. 23, 1999.

* cited by examiner

*Primary Examiner*—Jeffrey W Donels
(74) *Attorney, Agent, or Firm*—Jacobson Holman PLLC

(57) ABSTRACT

The composition assisting device of the present invention allows a user to input a melody, for example 10 melodic events, and the device outputs a series of new melodies. The new melodies have the same number of melodic events as the inputed event, but the order of the melodic events are different from the input melody. The output melodies are generated and based on a number of parameters that are set by the user. Therefore, the present invention allows a musical composer access to a set of melodies that can be used to assist the creative process of creating a musical piece.

9 Claims, 4 Drawing Sheets

COMPOSITION ASSISTING DEVICE

Figure 1:
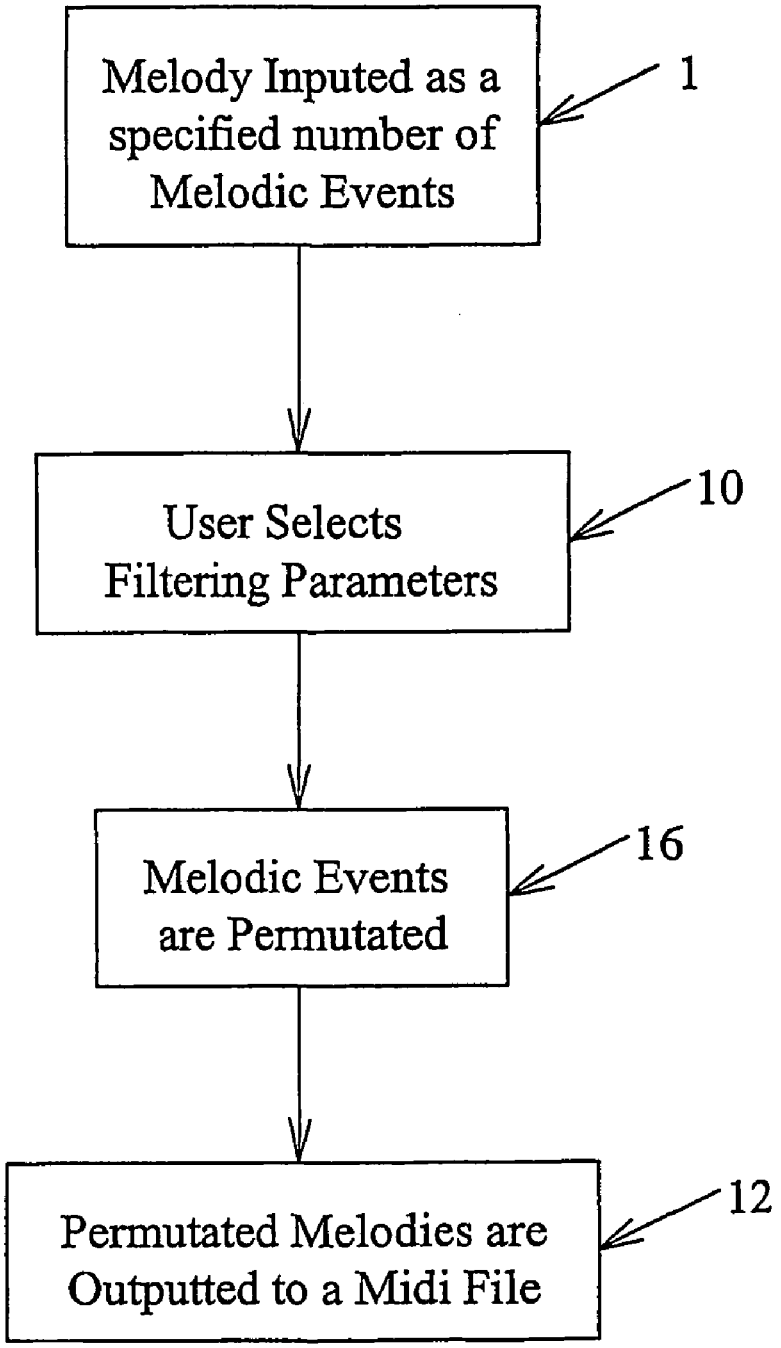

This is a nationalization of PCT/NZ02/00043 filed Mar. 27, 2002 and published in English.

BACKGROUND TO THE INVENTION

1. Field of the Invention

This invention relates to musical apparatus. In particular the invention pertains to a melodic processor which generates melodic variations and presents these variations in many different user selected ways as raw melodic data for the user (composer, songwriter or improviser) to use as thematic variations in their compositional song writing and improvisational processes and products.

2. Summary of the Prior Art

A key attribute of the composer, songwriter or improviser is an ability to craft finished works from a thematic idea. The fundamental skill is thematic development. This skill set consists of a number of techniques including, retrograde, pitch inversion, diminution, augmentation, permutation and so on. The art of thematic development (composition) is predominantly taught by private teachers and teachers employed by tertiary institutions. This enterprise is hindered by the absence of a teacher, student and classroom friendly technology able to produce variations on any given theme in very short times (for example, within seconds and/or minutes). It is also hindered by a reliance on the variability of standards of individual teacher capability.

The operational process of composition is to originate or nominate a theme, generate melodic variations and select and arrange these, with other material, into a thematically cohesive piece.

The absence of a user friendly technology, able to produce a user determined number of variations on any given theme, discourages the budding composer, songwriter or improviser, from generating melodic variations, which terminates or prolongs the compositional process, and reduces the chances of successfully producing thematically cohesive results, that is, a song.

The disadvantage of current compositional teaching and composing practises is that it takes so much time (at least a minimum of hours, typically of days and not unusually of weeks) to compose themes and variations. As noted the time involved stops a writer from completing a work, or at minimum, prolonging the process. Success under current convention is dependent on the composer accessing the state of "being in the mood" rather than accessing the variations unique to any theme.

No prior melodic processing technology delivers any user determined number of variations on a theme to a composer or songwriter. Nor does any such technology allow the composer to choose the character of their variations, for example, the number of continuous melodic steps and initial and/or final note in a phrase.

The absence of a user friendly, melodic processing technology also discourages the improvisational performer, teacher or student from developing a strong melodic improvisational technique.

The melodic improviser needs to be able to compose thematic variations on any given melody like a composer, except that the improviser outputs in real time whereas the composer outputs in delayed time, for example, when the musician reads from the composers score anytime after it has been written. So, a composer composes musical pieces for performers to play at a different time or times in the future. While the improviser is the composer and performer, composing and performing in real time with no intention of necessarily improvising that melody ever again.

One disadvantage of the current improvisational art is a teacher emphasis on harmonic improvisational techniques. This is born of the absence of an appropriate melodic processing technology.

The song writing process is the same as composition with one key difference; lyrics are needed to fit a melody or a melody is needed to fit a lyric. Songwriters also need a way to apprehend melodic variations for any given melodic or lyrical phrase. This skill is essentially the same skill as thematic composition and melodic improvisation. This skill too is taught by private and institutional teachers and is constrained also by the absence of a user friendly, melodic processing technology that delivers any user determined number of variations on a theme to the songwriter.

Some melodic composing arts for the novice have been produced. These automatically compose a melody in real time. The key purpose of these composers is to compose music pieces comprising melody and harmony, for users with nil or little musical knowledge and to be automatically played by sound generators within the composer as a completed piece.

In particular, U.S. Pat. No. 4,399,731 discloses an apparatus for automatically composing a music piece, the apparatus comprises a storage means that stores plural kinds of pitch data. From this memory, at random extraction is made of the pitched data agreeing with predetermined musical conditions. The output from the apparatus is the generation of music sound and/or a music score.

U.S. Pat. No. 4,664,010 discloses a method and device for transforming melodic notes of a piece of music into different notes to obtain a new piece of music and transformation is performed in accordance with predetermined rules stored in a transforming means. The musical notes inputted into the apparatus are compared with a database of notes stored in a memory until a corresponding counterpart note is found. The output of the apparatus is a musical piece which is a counterpart of the original inputted musical piece.

U.S. Pat. No. 5,451,709 discloses an automatic composer for composing a melody in real time. Here various databases are used to generate new melody notes from old melody notes. The new melody notes are analysed based on melody pattern rules and composition conditions, wherein the output of the automatic composer is a song. The automatic composer also enables simultaneous composing and playing of the melody in real time.

U.S. Pat. No. 5,218,153 discloses a chord progression selection apparatus that includes a chord progression database containing a large collection of practical chord progressions with various kinds of style and harmonic rhythm. An analysing feature of the apparatus evaluates the suitability between a chord progression and a melody supplied from the user based on stored melody pattern rules.

U.S. Pat. No. 5,099,740 discloses an automatic composer which forms a rhythm pattern. An entire musical piece is composed in accordance with at least one of a sequence of tone pitches and a sequence of tone durations where the sequences define the inputted portion of the musical piece. This provides automatic harmony evaluation and includes editing or correcting facilities for a music piece.

U.S. Pat. No. 5,088,380 discloses a melody analyser which analyses a given melody with respect to individual melody notes within.

U.S. Pat. No. 5,003,860 discloses an automatic accompaniment apparatus which plays in real time an accompaniment line formed by a succession of harmonic and nonharmonic tones. The apparatus determines the key in the current chord interval from a series of chords supplied from a musical piece. An arpeggio generator forms the arpeggio portion of the accompaniment line and a nonharmonic generated produces the nonharmonic portion of the accompaniment line.

U.S. Pat. No. 5,982,643 discloses an automatic composer of a music piece which comprises inputting a melody and a chord progression forming part of a music piece wherein a melody analyser extracts parameters characterising the input melody and a melody generator develops a melody forming the remainder of the music piece. The composer also provides a database of musical knowledge which is used by both the melody analyser and generator. Here the outputted synthesised melody will fit well with the input melody.

The key limitation of the abovementioned inventions is that they do not provide a non novice composer, song writer or improviser with raw melodic data from which they can make their own aesthetic and artistic selection and stylistic rules. Moreover these inventions deliver a final composition that excludes the user from the creative process.

Some random variation melodic composing arts for the non novice have been produced. Dr T's Keyboard Controlled Sequencer, by Emile Tobenfield© 1986–88 features a Programmable Variations Generator that supplies a random melodic generation capability. Vision 1.02, by Opcode Systems© 1985–89, features a generated sequence function which allows a user selected predefined pitch sequence and a user selected predefined rhythm sequence to be combined and generated into a new melody.

The uncontrollable randomness of DR T and the slow, time intensive, hand compilation processes of Vision 1.02, combined with the fact that these capabilities were conceived as add-ons to the primary application function of sequencing, do not produce composer-useful, song writer-useful or improviser-useful, melodic variations in short times.

These prior art specifications fail to present to a composer or songwriter a corpus of thematic variations to the user. Furthermore, they disallow the user the opportunity to subjectively select their preferred variation/s and disallow the user to store the corpus for later use. Most importantly, the prior art excludes the composer and melody writer from the creative process.

SUMMARY OF THE INVENTION

Accordingly it is an object of the present invention to provide a composition assisting device that overcomes the abovementioned disadvantages or which will at least provide the public with a useful choice.

In a first aspect the present invention consists in a composition assisting device comprising:

(a) melody input means to allow a user to input at least one melodic event into said device,
(b) filter input means to allow said user to input melody filters into said device,
(c) memory storage means to store said at least one melodic event and said melody filters in said device,
(d) melody permutation means, which permutates said at least one melodic event and produces a set of permutated melodies,
(e) filtering means, which filters said set of permutated melodies,
(f) melody output means, which outputs said filtered and permutated melodies to an electronic music file readable by said user.

Preferably said composition assisting device further comprises:

(g) rhythmic calculation means that is that calculates the rhythmic weight of each of said permutated melodies, and
(h) ordering means which orders said permutated melodies within said electronic file according to each said permutated melodies said rhythmic weight.

In still a further aspect the present invention consists in a method of operation for a composition assisting device comprising:

(a) accepting a user entered at least one melodic event,
(b) accepting a user entered at least one filtering parameter,
(c) storing said at least one filtering parameter in a memory means,
(d) permutating said at least one melodic event to produce a set of permutated melodies,
(e) comparing said set of permutated melodies with said at least one filtering parameter,
(f) discarding permutated melodies that do not meet said at least one filtering parameter, and
(g) outputting said permutated melodies that meet said filtering parameters to an electronic music file.

Preferably said method of operation of said composition assisting device further comprises the steps, after (c) above, of:

(h) accepting a user selection of at least one fixed event from said at least one melodic event,
(i) removing said fixed events from said at least one melodic event,
(j) storing said at least one fixed event and each fixed events' position within said at least one melodic event in a second memory means,
(k) during said permutation in step (d) above the melodic event that is permutated is said melodic event less said at least one fixed event, and
(l) inserting each of said at least one fixed event into each permutated melody of said set of permutated melodies at a position analogous to the position of said at least one fixed event in said at least one melodic event.

In still a further aspect the present invention consists in a computer program, which causes a melody to be composed, that comprises:

(a) accepting a user entered at least one melodic event,
(b) accepting a user entered at least one filtering parameter,
(c) storing said at least one filtering parameter in a memory means,
(d) permutating said at least one melodic event to produce a set of permutated melodies,
(e) comparing said set of permutated melodies with said at least one filtering parameter,
(f) discarding permutated melodies that do not meet said at least one filtering parameter, and
(g) outputting said permutated melodies that meet said filtering parameters to an electronic music file.

Preferably said computer program further comprises:

(h) accepting a user selection of at least one fixed event from said at least one melodic event,
(i) removing said fixed events from said at least one melodic event,
(j) storing said at least one fixed event and each fixed events' position within said at least one melodic event in a second memory means,
(k) during said permutation in step (d) above the melodic event that is permutated is said melodic event less said at least one fixed event, and
(l) inserting each of said at least one fixed event into each permutated melody of said set of permutated melodies at a position analogous to the position of said at least one fixed event in said at least one melodic event.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

BRIEF DESCRIRPTION OF THE DRAWINGS

Figure 2:
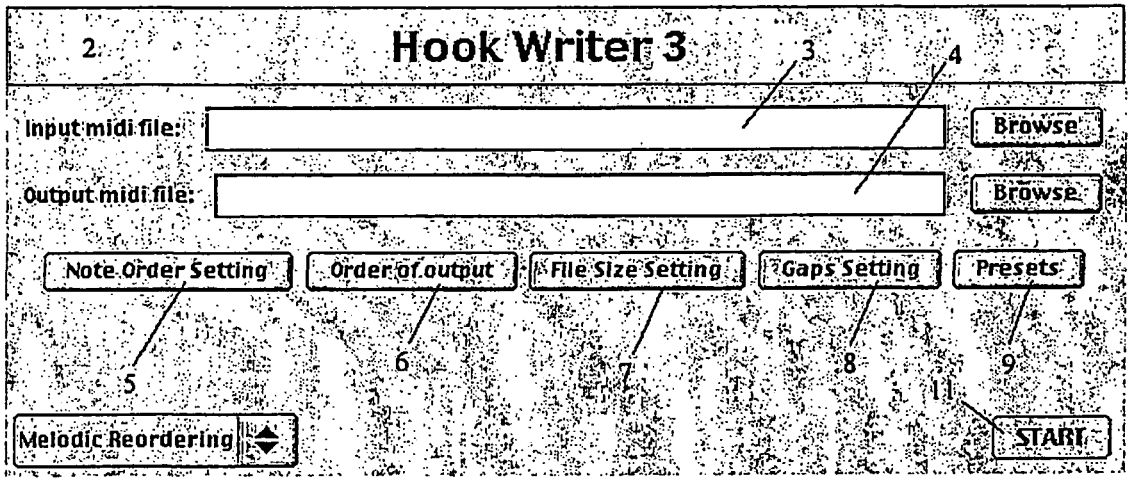
Figure 3:
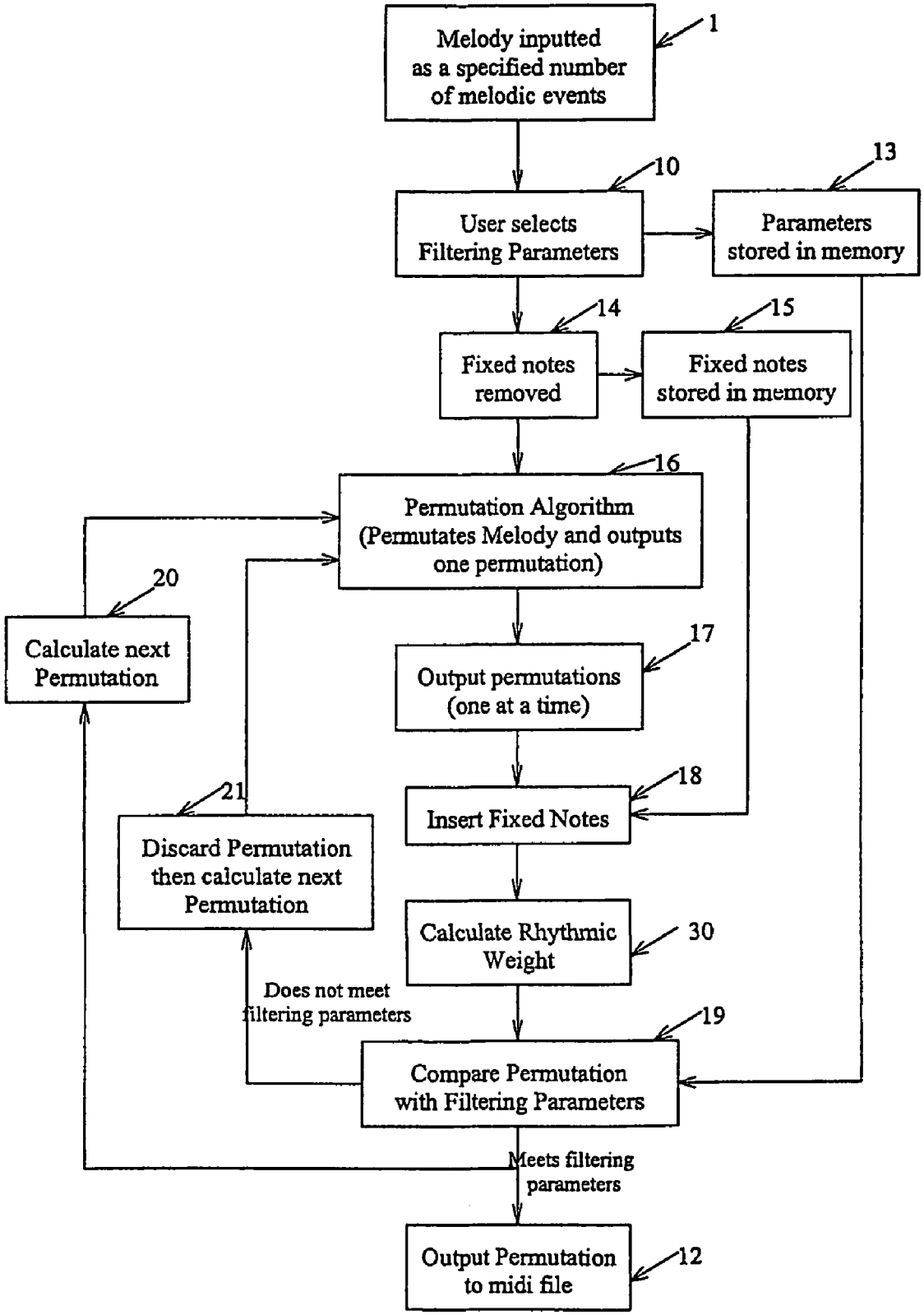
Figure 4:
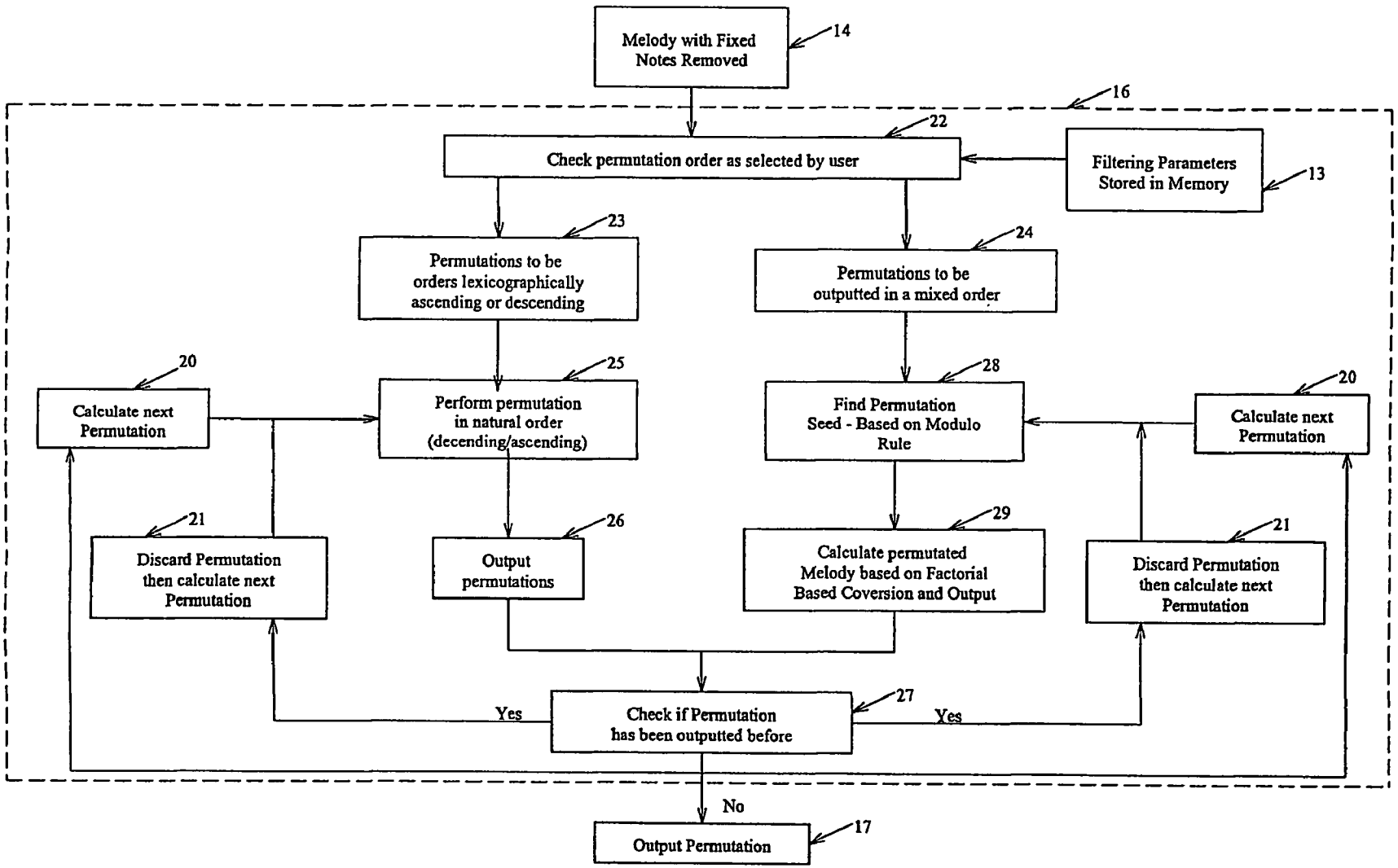

One preferred form of the present invention will now be described with reference to the accompanying drawings in which:

FIG. 1 shows the broad steps performed by the software of the melodic processor of the present invention, FIG. 2 shows the screen drop of the graphical interface of the present invention, FIG. 3 shows a more detailed illustration of the steps performed by the software of the melodic processor of the present invention, and FIG. 4 shows an illustration of the permutation algorithm used in the melodic processor of the present invention.

DETAILED DESCRIPTION OF THE PREFERRED EMBODIMENTS

In the preferred form the composition assisting device of the present invention allows a user to input a melody, preferably of a limited number of notes, for example 10 melodic events, and the device outputs a series of new melodies having the same number of melodic events but where the order of the melodic events are different from the input melody. The output melodies are generated and based on a number of parameters that are set by the user. Therefore, the present invention allows a musical composer access to a set of melodies that can be used to assist the creative process of creating a musical piece.

Referring to FIGS. 1 and 2, a user inputs a melody into the computer program 1 via a keyboard or through a drag and drop graphical user interface 2. A screen drop of the graphical user interface 2 is shown in FIG. 2.

Firstly the user selects the input midi file 3 which is the input melody which preferably is a midi file of 13 non-fixed melodic events or less. The user then inputs a name of the midi file 4 in which the output melodies are outputted to.

Once the melody is inputted the user then selects, by making selections from drop down boxes (5, 6, 7, 8 and 9), the filtering parameters 10 (see FIG. 1) that the composition device will use to narrow the results from the permutated input melody. The input melody is then permutated 16 once the start 11 is pressed and the output permutations are filtered based on the user selected parameters 10, where those permutated melodies matching the filtering parameters are outputted to a midi file 12. These midi files can be viewed by the user through notation software or can be played with midi playing or sequencing software. The notation software and midi playing or sequencing software are not included within the scope of this invention.

The user selected parameters 10 (as shown in FIG. 1) will now be described. Firstly, the user may select whether or not to fix the position of on of or a number of the inputted melodic events within the output melody. Therefore, the apparatus of the present invention will only permutate the unfixed melodic events. The user may also select how to order the output data, in particular whether the output is of a single pitch, where the output would be suitable for a melody that could be played by bass instruments, drums or unpitched percussion instruments, that is, the timing and duration of the melodic events are permutated but the pitch or notes remain the same value.

Furthermore, output data may be ordered, during the permutation selection process, lexicographically in a descending, mixed or ascending order. The purpose of giving the user this type of selection is to allow the user to order data in ways that are of particular use to him or her. For example, if the user wants an overview of the melodic options through a representative sample, then mixed order would be selected. Alternatively, if the user was interested in descending melodic options for their particular purpose then they select descending lexicographic order. Conversely, if ascending order melodies were the subject of user interest then ascending lexicographic order would be selected.

The user may also restrict the output file size. In restricting the file size the user can restrict how many resulting permutated melodies are outputted. Also restricting the file size may reduce the time to complete the permutation and output the file as well as to reduce the amount of memory used on the computer. Alternatively, the user may select a restricted file size but also request a number of files of this size to be outputted. For example, the user may select a file size of 25 kilobytes and wish the output to be 5 sub-files each of 5 kilobytes.

A further parameter that may be used to filter the permutated melodies is to restrict the output to those permutations that have a certain melodic continuity. Where a high melodic continuity results in a more scaler melody, that is, a melody that resembles a musical scale and where a melody with low melodic continuity would result in a melody that was disjointed where the notes are further away from each other on the scale thereby resulting in a melody that is harder to sing and/or play.

The user may also set the timing between the output melodies. The outputted midi file gives a string of melodies where if no timing gap was placed between each permutated melody the melodies would run in a string. Therefore for ease of listening and/or reading the user will put a preselected amount of timing gaps that are a specified number of bars that represent a silent period between each melody permutation when listened to.

Finally, the user may select whether to accept melodic permutation, rhythm permutation or pitch permutation. With a melodic permutation both the rhythm and pitch of the melody are permutated. Whereas with a rhythm permutation, the pitch of the melody remains constant and the rhythm. (ie. the timing or duration of the notes) is permutated. Here the pitch or notes remain the same and each note is reassigned a different duration, although the duration it is reassigned was originally assigned to a different note within the input melody. With a pitch permutation the duration assigned to each note in the input melody remains the same within the output melody and the note value of each of the melodic events is altered by permutation.

Referring now to FIG. 3, once the user has made the selections that will determine the permutations that are outputted from the program, a permutation is performed on the melody. Once the user has selected filtering parameters 2, and these parameters stored in a memory 13, the program removes any notes 14 that were fixed by the user within the selection parameters and stores these fixed notes in a memory 15. The remaining melodic events are then permutated 16 using an algorithm soon to be described and illustrated in FIG. 4. Next each permutated melody outputted 17 has the fixed notes, as stored in memory 15, placed back 18 into the permutated melody. Then the permutated melody is compared 19 to the filtering parameters 10 as set initially by the user and stored in memory 13 by the melodic processor. If the permutated melody meets the filtering parameters it is outputted to the output file 12 and the next permutation 20 requested from the permutation algorithm 16. If the permutated melody outputted after the fixed notes 15 are inserted back into it 18 does not meet the filtering parameters 10 it is discarded 21 and the next permutation requested from the permutation algorithm 16.

The permutation algorithm will now be described with reference to FIG. 4. Firstly, the melody with the fixed notes removed 14 is placed in a memory, for the purposes of explanation an example of a 4 event melody will be used. This means the total permutations of the 4 melodic events is 24 (or 4!). Firstly, the permutation order as selected by the user is checked 22 by looking at the user selected parameters stored in memory 13 (see FIG. 3). If the user wishes the output of the permutations to be listed in the natural permutation order lexicographically ascending, then the first permutation is outputted from the algorithm then the second and so on. Alternatively, if the output of the permutations is required to be listed in the natural permutation order lexicographically descending, then the first permutation outputted would be the 24th permutation, then the 23rd and so on. For lexicographical ordering module 23 is used. If following module 23, lexicographical ordering of the permutated melodies occurs 25, where each new permutation slightly differs from the last outputted melody. A permutated melody is outputted 26, and a check is made to determine whether this melody has been outputted before 27. If it has then the melody is discarded 21 and the next permutated melody is requested. Alternatively, if the permutation 26 hasn't been outputted previously then it is outputted to the electronic file 17 and then the next permutated melody 20 is requested. This process is followed until the electronic file 9 has reached it's specified size or all possible permutated melodies have been outputted.

Alternatively, if the output of the permutations is required to be listed in a mixed order then the melodic events are permutated based on modulo and factorial based rules following module 24. Firstly, a permutation seed 28 is calculated in order to determine which of the total set of permutations (in this example, 24) to output first. This decision is reliant on a modulo rule where the permutation seed (the number of the permutations to be calculated first from the total set of permutations) is calculated by the following equation:

$$\text{seed}_n=(\text{seed}_{(n-1)}+\text{gap})\bmod tp$$

where:

tp=the total number of permutations=24 (in this example)

$\text{seed}_0=0$ n=0, 1, 2, 3, 4, . . .

gap=round (tp. π/4.5), which in this example is 17.

So once the gap is calculated for the total number of permutations (ie. 17 in this example) the gap is compared with tp, if both are co-prime then 17 is used. If not, for example when gap=16, then a new gap must be calculated using the following formula:

$$\text{gap}_{new}=\text{gap}_{old}-1$$

So, $\text{gap}_{new}=15$, again this is checked to see if the tp (=24) and 15 are co-prime. 24 and 15 are not co-prime so this process occurs until a value of gap is reached that is co-prime with tp.

In this example 17 is co-prime with 24 and so gap=17. Therefore, $$seed_1 = (0 + 13) \bmod(24) = 17$$

and, $$seed_2 = (17 + 17) \bmod(24) = 8$$

. . .

. . . and so on.

Therefore, the first permutation that is taken from the total permutation set (tp=4!=24) is the 17th permutation and then the 8th and so on, as calculated using the modulo rule above. This mixing of the order of retrieval of permutated melodies has the purpose of ensuring that the resultant output melodies will differ greatly from one another due to the order placed within the output file.

Next, in order to reduce the time taken to produce permutations and eliminate the need for the processor to produce all permutations (24 in this example) in lexicographical order and then choosing the 17th permutation from this set, a factorial based rule is used. Firstly, the permutation seed is converted to its factorial based factors. For example, $\text{seed}_1=17$, where the factorial conversion is $17=2\times6+2\times2+1\times1=2\times3!+2\times2!+1\times1!$, and 17 has a factorial base of 2 2 1. In this example, an additional 0 is added to this factorial base (ie. 2 2 1 0) as the melodic input has 4 events, say A B C D. Let us denote A as the 0th element, B as the 1st element, C as the 2nd element and D as the 3rd element. According to the factorial base 2 2 1 0 the algorithm removes the 2nd element, C, and places it in a 1 st position of the new permutation. Next it takes from the remaining 3 elements, A B D, and removes the 2nd element, which is now D, and places it in the 2nd position of the new permutation. Next, from the remaining 2 elements the 1st element, B, is placed in the 3rd position and the last remaining element A is placed in the 4th position of the new permutation. This results in the new permutation C D B A, which is the 17th permutation when A B C D is permutated in lexicographical order.

Again, as the device of the present invention continues to output permutated melodies 29 in mixed order, a check is made to determine whether the melody has been outputted before 27, so as to eliminate repetition in the output melodies. If the melody has been outputted before then it is discarded 21 and the next permutation is requested. Alternatively, if the permutation 26 hasn't been outputted previously then it is outputted to the electronic file 9 and then the next permutated 20 melody is requested. Again, this process is followed until the electronic file 9 has reached it's specified size or all possible permutations have been outputted.

Once the permutation is complete, the output file 4 (a midi file), (see FIG. 2), can be accessed by the user so as to view or listen to the permutated melodies contained within the midi file. The user may do this by opening the midi file to read the musical notation via notation software or listen to the melody via midi playing or sequencing software.

Referring to FIG. 3, in the preferred form of the present invention a calculation may also be made of the rhythmic weight 30 of the outputted permutated melody before it is compared with the filtering parameters 19. After the calculation is made on the output melody a value is assigned to it, and the permutated melodies are sorted within the output file 12 according to rhythmic weight. The purpose here being that those permutations with higher rhythmic weights are generally more commercially acceptable melodies, while those with lower weights are generally not and are likely to be more appropriate for non-mainstream uses like avant-garde music. Therefore, by ordering the output melodies within the output midi file based on rhythmic weight, where those with higher rhythmic weights are placed first in the output file, when a user listens or views to the output file those permutations with higher rhythmic weights will be listened to or viewed first.

I claim:

1. A composition assisting device comprising:

(a) melody input means to allow a user to input at least one melodic event into said device, (b) filter input means to allow said user to input melody filters into said device, (c) memory storage means to store said at least one melodic event and said melody filters in said device, (d) melody permutation means, which permutates said at least one melodic event and produces a set of permutated melodies, (e) filtering means, which filters said set of permutated melodies, (f) melody output means, which outputs said filtered and permutated melodies to an electronic music file readable by said user.

2. A composition assisting device according to claim 1 wherein said composition assisting device further comprises fixed event input means to allow said user to fix at least one of said events of said at least one melodic event.

3. A composition assisting device according to claim 1 wherein said composition assisting device further comprises:

(g) rhythmic calculation means that calculates the rhythmic weight of each of said permutated melodies, and (h) ordering means which orders said permutated melodies within said electronic file according to each said permutated melodies said rhythmic weight.

4. A composition assisting device according to claim 1 wherein said composition assisting device uses at least one mathematical algorithm in the production of said set of permutated melodies based on said at least one melodic event.

5. A composition assisting device according to claim 1 further comprising a user selection that allows for restriction in the size of said outputted electronic music file.

6. A composition assisting device according to claim 5 wherein said user selection further allows said electronic music file to be outputted as a number of files each of a size as selected by said user.

7. A method of operation for a composition assisting device comprising:

(a) accepting a user entered at least one melodic event, (b) accepting a user entered at least one filtering parameter, (c) storing said at least one filtering parameter in a memory means, (d) permutating said at least one melodic event to produce a set of permutated melodies, (e) comparing said set of permutated melodies with said at least one filtering parameter, (f) discarding permutated melodies that do not meet said at least one filtering parameter, and (g) outputting said permutated melodies that meet said filtering parameters to an electronic music file; wherein said method of operation of said composition assisting device further comprises the steps after (c) above of:

(h) accepting a user selection of at least one fixed event from said at least one melodic event, (i) removing said fixed events from said at least one melodic event, (j) storing said at least one fixed event and each fixed events' position within said at least one melodic event in a second memory means, (k) during said permutation in step (d) above the melodic event that is permutated is said melodic event less said at least one fixed event, and (l) inserting each of said at least one fixed event into each permutated melody of said set of permutated melodies at a position analogous to the position of said at least one fixed event in said at least one melodic event.

8. A computer program, stored on a medium which causes a computer to perform a method of composing a melody, that comprises:

(a) accepting a user entered at least one melodic event, (b) accepting a user entered at least one filtering parameter, (c) storing said at least one filtering parameter in a memory means, (d) permutating said at least one melodic event to produce a set of permutated melodies, (e) comparing said set of permutated melodies with said at least one filtering parameter, (f) discarding permutated melodies that do not meet said at least one filtering parameter, and (g) outputting said permutated melodies that meet said filtering parameters to an electronic music file.

9. A computer program, which causes a melody to be composed, according to claim 8 wherein said method further comprises:

(h) accepting a user selection of at least one fixed event from said at least one melodic event, (i) removing said fixed events from said at least one melodic event, (j) storing said at least one fixed event and each fixed events' position within said at least one melodic event in a second memory means, (k) during said permutation in step (d) above the melodic event that is permutated is said melodic event less said at least one fixed event, and (l) inserting each of said at least one fixed event into each permutated melody of said set of permutated melodies at a position analogous to the position of said at least one fixed event in said at least one melodic event.

* * * * *